United States Patent [19]

Boissière

[11] 4,362,518

[45] Dec. 7, 1982

[54] COMBINED KICK BOARD AND ARM STROKE SWIMMING PRACTICE DEVICE

[75] Inventor: Guy Boissière, Rouen, France

[73] Assignee: Adidas Fabrique de Chausseurs de Sport, Landersheim, France

[21] Appl. No.: 195,497

[22] Filed: Oct. 9, 1980

[30] Foreign Application Priority Data

Oct. 12, 1979 [FR] France ..... 79 25458

[51] Int. Cl.[3] ..... A63C 5/00; A63C 9/00; A63C 11/00; A63C 15/00

[52] U.S. Cl. ..... 441/60; 441/88; 272/1 B

[58] Field of Search ..... 272/1 B; 114/267, 315, 114/61, 283, 292; 434/254; 9/301, 307, 310 R, 310 B, 310 C, 310 E, 310 G, 310 H, 310 J, 311, 312, 6 P; D21/237; 441/55–79

[56] References Cited

U.S. PATENT DOCUMENTS

| | | | |
|---|---|---|---|
| D. 203,365 | 12/1965 | Heston | D21/237 |
| D. 246,066 | 10/1977 | O'Farrell | D21/237 |
| 1,461,911 | 7/1923 | Jordahn | 9/310 F |
| 1,552,298 | 9/1925 | Harootunian | 9/311 |
| 2,327,794 | 8/1943 | Hurt | 9/310 F |
| 3,528,116 | 9/1970 | Fenar | 272/1 B |
| 4,074,381 | 2/1978 | Patton | 9/301 |

*Primary Examiner*—Trygve M. Blix
*Assistant Examiner*—D. W. Keen
*Attorney, Agent, or Firm*—Brisebois & Kruger

[57] ABSTRACT

The practice device has convexly rounded streamlined sides which flank a flat thinner center portion to provide hollows at each face which generally conform to the insides of the thighs of the user and is held between the thighs during arm stroke practice. During leg kick practice the sides of the device are held by the hands of the swimmer for use as a "kick board". Hand hold recesses can be provided on the sides to facilitate gripping during kick-board use, and the sides of the hollows can diverge to better conform to the configuration of the insides of the thighs.

6 Claims, 7 Drawing Figures

COMBINED KICK BOARD AND ARM STROKE SWIMMING PRACTICE DEVICE

BACKGROUND OF INVENTION

The present invention relates to a device for learning and practicing swimming techniques, permitting teaching and improvement alternatively, of the kicks of the legs and the strokes of the arms.

One uses usually for practice of leg techniques devices known by the name of "kick boards" which the user holes at arm's length in the water, thus permitting him to perform movements of the legs while being maintained in an elongated position in the water because of the buoyancy of the board.

One is also familiar with a device usually called a "Pull-Buoy" for practicing arm strokes. These devices are usually made of two small floats joined by a flexible strap, such as a fabric web, a small rope or cord, or elastic strands, the two floats being placed above and below the legs of the user, in particular, in the area of the thighs. The legs thus being blocked by squeezing the device, and buoyed up, the user can make arm stroke movements while being maintained in an elongated horizontal position in the water.

Such devices, although presently used, are really not very satisfactory. Thus, the devices with connecting cords are hard to use because of the necessity of adjusting the length of the cords connecting the floats.

The devices with fabric webs or elastic strands cause, on the one hand, irritations in the area of the thighs of the user and, on the other hand, require a significant muscular contraction of the legs of the user to maintain the device correctly positioned between the insides of the thighs.

For practicing arm strokes one is also familiar with devices consisting of a ring, of rubber or a similar material, of relatively small diameter placed around the ankles for holding both feet together simultaneously while leaving the arms free. Such a ring imprisoning the ankles is not very comfortable for the user and is relatively difficult to put on and to take off.

Besides the specific disadvantages of each of these devices, one notices that none of them can be used by the user, both for practicing arm strokes and alternately, practicing leg kicks.

SUMMARY OF THE INVENTION

The present invention consequently proposes to provide an economical convenient device, which can be used equally well for practicing arm strokes or leg kicks, and which also eliminates the disadvantages mentioned above of previously known devices.

The present invention has as its object, by way of new industrial product, a device for learning and practicing swimming techniques, characterized by the fact that it is constituted of a rigid elongated body, buoyant, made in one piece, having two side portions or zones with transverse sections which are of convex profile and in longitudinal section are symmetrical with respect to the longitudinal axis of the body, and whose internal flanks outline or delimit a central zone, of constant thickness, thinner than the side portions, the flanks defining above and below the central zone, identical longitudinal hollows, for placing the device between the insides of the thighs of the user.

Preferably, the internal flanks of the side portions diverge with respect to the longitudinal axis of the device so as to create hollow sections of increasing width adapted to the morphology of the thighs.

In a particularly preferred embodiment of the invention, the device also includes in the side portions recesses for improving the gripping of the device by the hands of the user for the practice of leg kicks.

These recesses are preferably made in the area of the external flanks of the side portions to allow a manual grip on either side of the device.

The device according to the invention can be made of any appropriate material having the requisite characteristics or rigidity and buoyancy.

In particular, one may use expanded materials moldable in a single piece to the requisite shape or fabricated from a blank.

In order to make the invention better understood, one embodiment will now be described by way of non-limiting example with reference to the attached drawings.

The device according to the invention takes the form of an elongated body 1 made in one piece of a rigid material having good buoyancy characteristics.

The device comprises two side zones or portions 2 which are symmetrical with respect to the longitudinal axis of the body.

Figure 4:
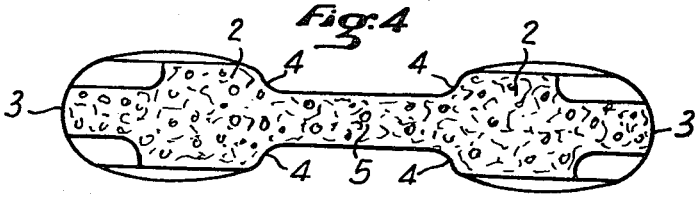
FIG. 4 is a view in section along the line IV—IV of FIG. 3.
Figure 5:
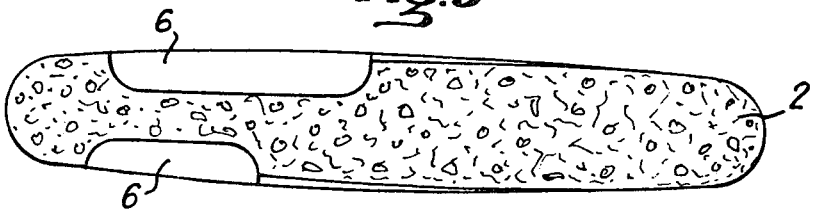
FIG. 5 is a view in section alone line V—V of FIG. 3.

The convex form and profile of side portions 2 of the device according to the invention can best be seen on the sectional views of FIGS. 4 and 5.

Thus, as can be seen on FIG. 4, the device according to the invention has a transverse section basically in the shape of a dumb-bell, the lateral side portions 2 each having a basically oval transverse section.

This transverse section combined with the streamlined contoured longitudinal section as seen on FIG. 5 gives the device according to the invention good hydrodynamic properties.

Side portions 2 have external sides or flanks 3 of convex rounded form, with their generatrices parallel to the axis of the body.

Figure 1:
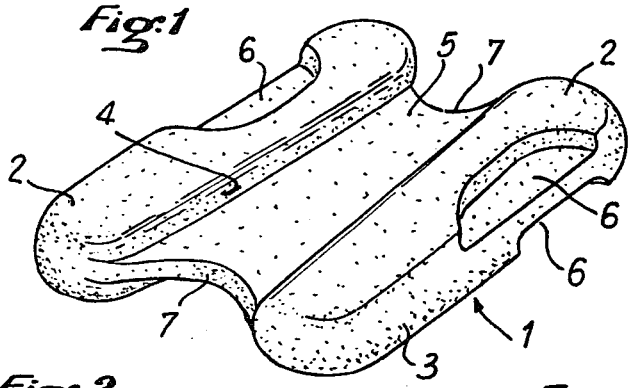
FIG. 1 shows, in three-quarter perspective, a device according to the invention.
Figure 2:
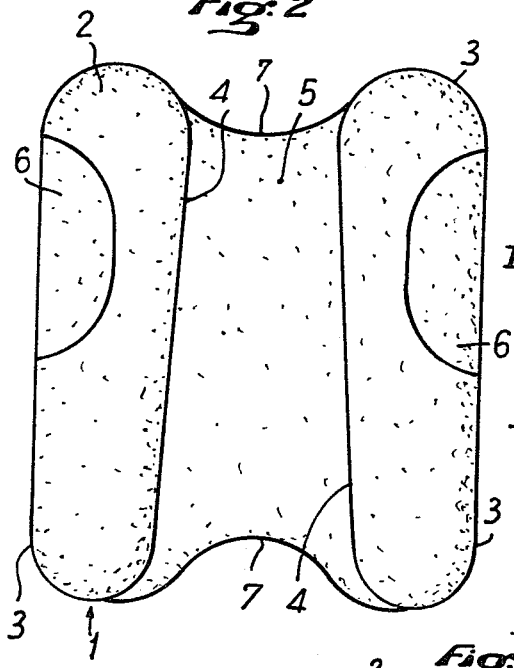
FIG. 2 is a top view of the device of FIG. 1.
Figure 3:
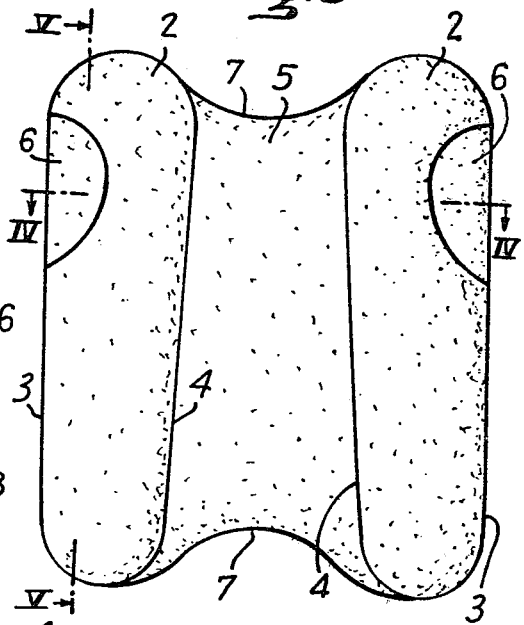
FIG. 3 is a bottom view of the device of FIG. 1.

The internal flanks 4 of the side portions, of rounded form, have generatrices which diverge slightly, as is best seen on FIGS. 2 and 3.

Between the side portions 2, body 1 presents a central zone or portion 5, which, as is best seen on FIG. 4, has a constant thickness less than that of the side portions 2.

Figure 7:
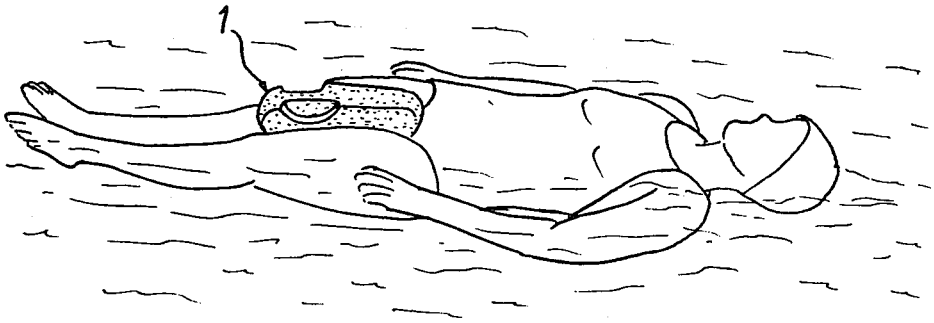
FIG. 7 illustrates the use of the device according to the invention for practicing arm strokes.

Due to the relative disposition of the central portion and the side portions, the device according to the invention thus presents at either face of central portion 5, hollows or recesses defined by the internal flanks 4 of side portions 2, these recesses having a width which increases in the longitudinal direction of the device, thus allowing the comfortable placement of the device between the insides of the thighs of a user as is shown in FIG. 7.

Figure 6:
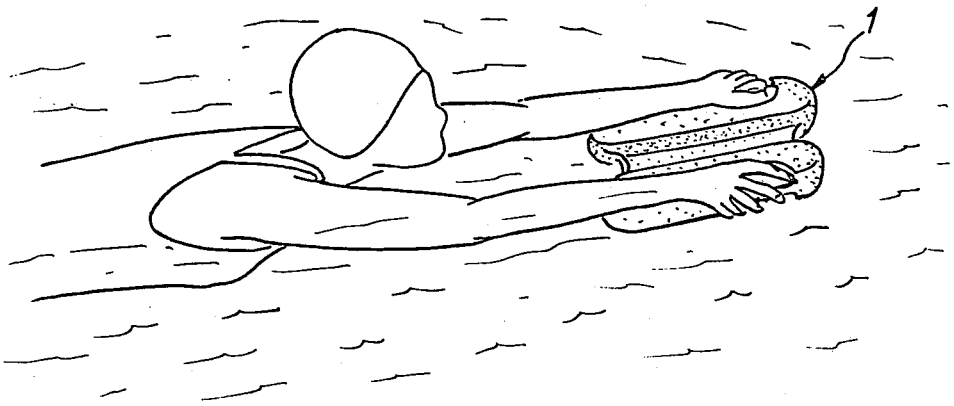
FIG. 6 illustrates the use of the device according to the invention for practicing leg kicks.

To improve the manual grip of the device for practicing leg kicks, as illustrated in FIG. 6, the device according to the invention also has recessed portions 6 formed in the external flanks 3 of side portions 2, and which are offset toward the front of the device when used as shown at FIG. 6.

As is shown in FIG. 6, these recessed portions 6 allow a good manual grip on either side of the device.

To further improve the hydrodynamics and to improve comfort when held between the thighs, the central portion 5 can have concavely rounded ends 7, which have convex streamlined edges.

Although the invention has been described in connection with a particular embodiment, it is of course evident that it is in no way thereby limited and that it may undergo numerous variations and modifications without exceeding either its scope or its spirit.

What is claimed is:

1. A combined kick board and leg float device for practicing swimming techniques either by holding the device at arm's length with the swimmer's hands to practice leg kicks, or holding the device between the swimmer's thighs to practice arm strokes, said device comprising a rigid elongated one piece buoyant body, having two spaced apart side portions each of transverse sections which are convex and contoured, and longitudinal sections which are symmetrical with respect to the longitudinal axis of the body, said side portions having internal flanks delimiting a central portion, of constant thickness, thinner than said side zones, the flanks defining above and below the said central portion identical continuous longitudinal hollow sections from one end of the device to the other, said side portions comprising means for gripping the buoyant body with the hands of a swimmer while the swimmer's legs are free to practice leg kicks while holding the buoyant body in front of himself, said hollow sections comprising means for holding the device between the insides of the thighs of a swimmer to practice arm swimming strokes while the swimmer's arms are free and the swimmer's legs are buoyed and immobilized by gripping the device between his thighs.

2. A device according to claim 1, wherein the internal flanks of said side portions diverge with respect to the longitudinal axis of the device to define hollow sections of increasing width toward one end of the device.

3. A device according to claim 2 wherein said hollow sections at said one end of the device comprise a concave end to improve comfort when held between the thighs of the swimmer.

4. A device according to claim 1 or 2, further comprising recesses in said side portions presenting hand hold means for improving the manual grip of the device by a user practicing leg kicks.

5. A device according to claim 3, wherein said recesses comprise recesses in the region of external flanks of the side portions.

6. A device according to claim 1 wherein said hollow sections have at least one concave end.

* * * * *